United States Patent [19]

Spitzner

[11] 4,141,561

[45] Feb. 27, 1979

[54] GAME CARD ASSEMBLY

[75] Inventor: Erich A. Spitzner, Niles, Ill.

[73] Assignee: Regal Games Mfg. Co., Chicago, Ill.

[21] Appl. No.: 781,751

[22] Filed: Mar. 28, 1977

[51] Int. Cl.[2] ..... A63F 3/00

[52] U.S. Cl. ..... 273/271; 273/281; 116/323

[58] Field of Search ..... 273/130 B, 135 BC, 136 F; 116/135

[56] References Cited

U.S. PATENT DOCUMENTS

| | | | |
|---|---|---|---|
| 2,322,324 | 6/1943 | Spitzner | 273/135 BC |
| 2,813,504 | 11/1957 | Johnson | 116/135 |

FOREIGN PATENT DOCUMENTS

| | | | |
|---|---|---|---|
| 1280770 | 11/1961 | France | 273/130 B |

OTHER PUBLICATIONS

Regal Games Catalog Advertisement dated 1970.

*Primary Examiner*—Anton O. Oechsle
*Attorney, Agent, or Firm*—Norman H. Gerlach

[57] ABSTRACT

A game card assembly consisting of a plurality of superposed sheets which define a plurality of windows in vertical, horizontal, and diagonal rows, each window being provided with two laterally slidable shutters which are selectively movable back and forth between retracted substantially non-visible positions and predominately visible positions. The shutters of each window possess different distinguishing characteristics so that when either shutter is in its predominately visible position, its window as a whole is given a distinguishing characteristic. The various rows of windows are arranged in checkerboard fashion in order that vertical, horizontal or diagonal alignment of like shutters may form the basis for the playing of a game of the tic-tac-toe variety.

1 Claim, 8 Drawing Figures

GAME CARD ASSEMBLY

The improved game card assembly comprising the present invention is designed for use primarily in connection with the playing of a game which is similar to tic-tac-toe in that the object of the game is to align a plurality of identical symbols, that is, shutters having the same distinguishing characteristics, vertically, horizontally, or diagonally against the opposition of a player utilizing symbols, that is, shutters having different distinguishing characteristics.

The invention contemplates the provision of a flat multi-layer composite board-like game card assembly, the playing surface of which presents a plurality of windows across which respective play-making shutters are individually slidable. The windows are arranged in checkerboard fashion so as to present vertical, horizontal, and diagonal rows. The visual characteristic of each window may be varied by means of the two associated shutters which are selectively laterally slidable between normally retracted positions where a blank space remains visible through the window, and effective positions where one or the other shutter, in the main, extends across or substantially "closes" such window and thereby renders an indication in the window opening. The shutters of each pair are possessed of different visual characteristics so that two players, moving their respective designated shutters of the same distinguishing characteristics alternately from retracted positions to closed positions may attempt to win the game by one player effecting a series of four uninterrupted aligned identical window indications in any one of three directions, namely, vertical, horizontal, or diagonal.

The provision of a board-like game card assembly such as has been briefly outlined above constitutes the principal object of the present invention.

The provision of a card game assembly which may be manufactured entirely of die cut cardboard sheets and small shutter moldings or stampings, and also may be easily assembled without requiring skilled labor, thereby resulting in production at a relatively low cost; one which, when the game rules are followed, lends itself to the production of a game of the tic-tac-toe variety but which requires for the playing thereof the use of no pencil of other marking inplement; and one which is attractive in its appearance and pleasing in its design, are further desirable features which have been borne in mind in the production and development of the present invention.

Other objects and advantages of the invention will become more readily apparent from a consideration of the following detailed description.

The invention consists in the several novel features which are hereinafter described and more particularly defined by the claim at the conclusion hereof.

In the accompanying two sheets of drawings forming a part of this specification, one illustrative embodiment of the invention is shown.

Figure 1:
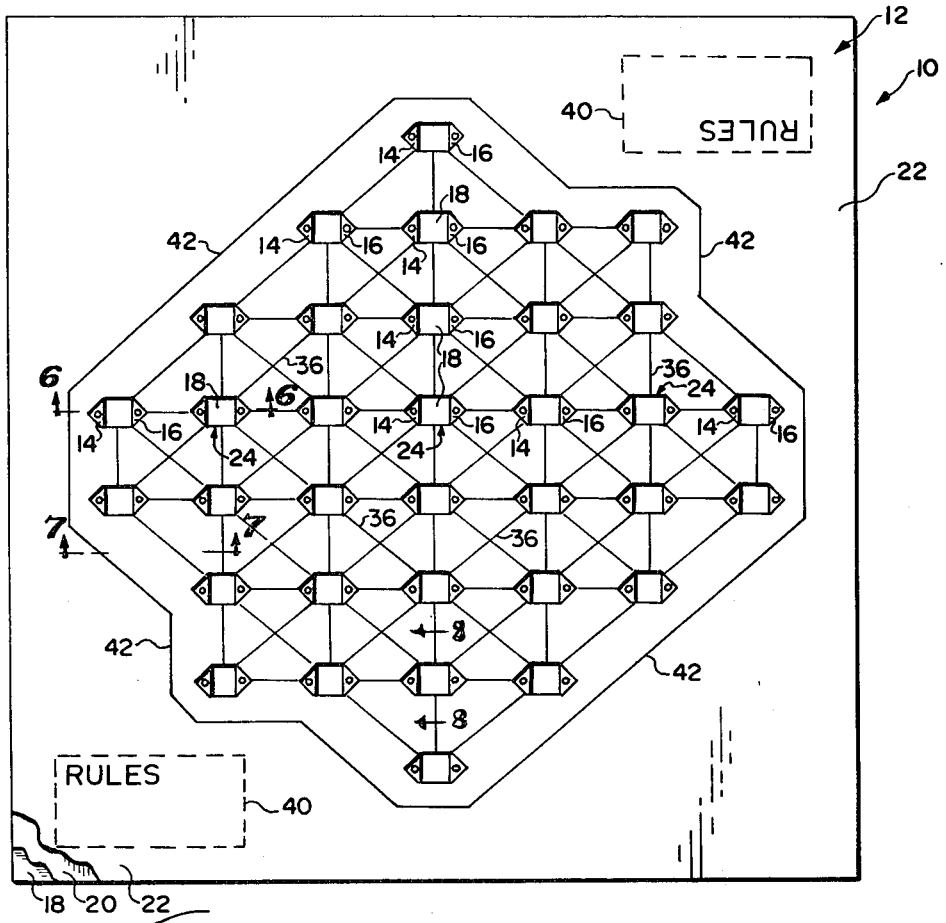
FIG. 1 is a front plan view of a board-like game card assembly embodying the invention, portions of the various cardboard sheets of the assembly being broken away in the interests of clarity.
Figure 2:
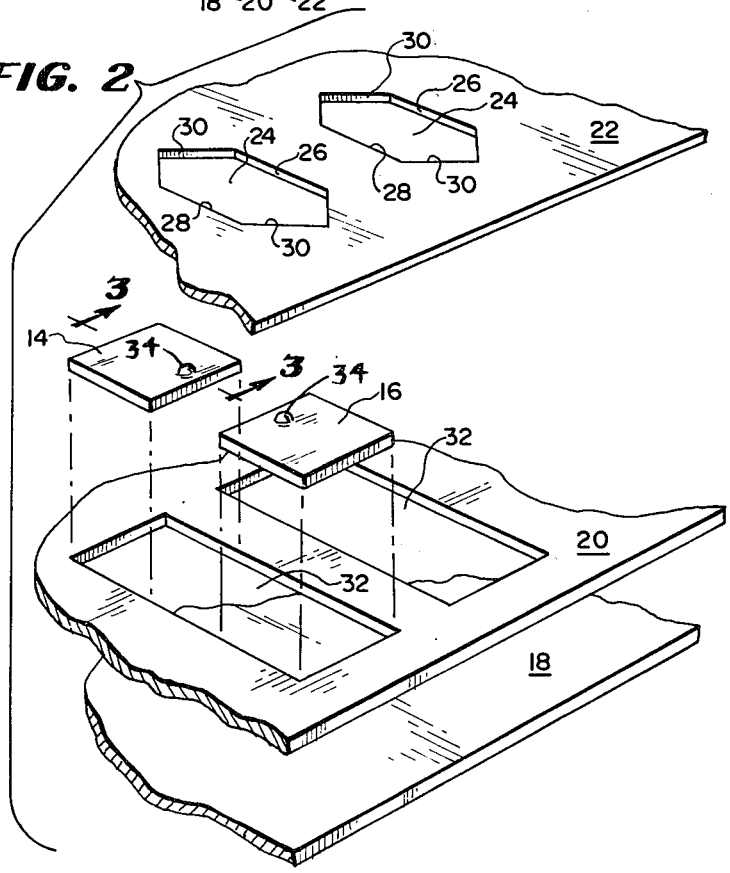
FIG. 2 is an enlarged, fragmentary, exploded, perspective view of an edge region of the game card assembly, illustrating the various cardboard sheets and the relationship which the pairs of slidably mounted shutters bear thereto.

Referring now to the drawings in detail and in particular to FIGS. 1 and 2, there is disclosed in these views a boardlike game card assembly 10 which is comprised of a three-ply or laminated game board proper 12, together with a series of laterally slidable slides or shutters 14 and a second series of laterally slidable slides or shutters 16 in opposed relation with the shutters 14. As best shown in FIG. 2 of the drawings, the game board proper 12 is comprised of three laminae or sheets 18, 20 and 22 and these are preferably of square configuration and are adhered to one another by a suitable adhesive, each sheet reinforcing the others so that a relatively rigid unbendable structure or assembly results. Associated with the assembled sheets 18, 20 and 22 are the aforementioned shutters, such shutters being arranged in pairs, each pair including a left shutter 14 and a right shutter 16, the nature and function of which will be made clear presently.

The three sheets are preferably, but not necessarily, formed of relatively stiff cardboard and the adhesive which binds adjacent sheets together may be coextensive with the abutting sheet surfaces or it may be applied in appropriate localized regions. However, in the interests of rigidity and edge sealing, it is preferable that the meeting surfaces of adjacent sheets be adhered coextensively around the rectangular border of the game board proper in order to exclude the entry of dirt or other foreign material into any spaces which may exist in between the three superposed sheets.

The sheet 18 is a plain rectangular uncut bottom backing sheet, the inside face of which is of a predominant color, preferably white. The intermediate sheet 20 constitutes a guide sheet for constraining the movements of the various pairs of shutters 14 and 16. The sheet 22 constitutes a top playing window-equipped sheet which cooperates with the intermediate guide sheet 20 in a manner that will become clear presently.

Considering now the top playing sheet 22, this sheet is a die cut sheet and it is provided therein with a plurality of hexagonal openings of windows 24, such openings being arranged generally in checkerboard fashion so that they present vertical, horizontal, and two-way diagonal rows of such windows. The particular number of windows 24 is not critical, nor is the spacing between adjacent windows of the vertical and horizontal rows necessarily equal. The main consideration is that the placement of the windows on the sheet 22 be such that plural vertical, horizontal, and two-way diagonal rows be maintained between the geometrical centers of the various windows. Actually, in the illustrated form of the invention, a true checkerboard arrangement of windows is not maintained, there being thirty-two windows which are arranged in vertical rows and horizontal rows with an over-all pattern that is bilaterally symmetrical in either its vertical or its horizontal direction. Considering the vertical rows of windows, there are seven such rows including a central row of eight windows on each side of which there are provided a row of six windows, a row of five windows, and a row of two windows, successively and in the order named. Considering the horizontal rows, there is a single window at the top and bottom of the window pattern, with a four-window row, a five-window row, and a seven-window row extending inwardly of the pattern from each of the top and bottom single windows. Although other window placements or patterns are contemplated, the aforementioned placement of the thirty-two windows 24 constitutes an advantageous feature of the invention in that it affords a maximum number of tic-tac-toe arrangements of shutters 14 or 16, as the case may be, within a minimum size window pattern as will become apparent when the nature of the game which is played on the game board proper 12 is set forth hereafter.

Considering now the shape or outline of the individual windows 24, each such window is in the form of a horizontally elongated hexagon (see particularly FIG. 2) having parallel edges 26 and 28, together with notch-like recesses 30 at their opposite ends. Because the various windows 24 are thus horizontally elongated on the playing face of the top playing sheet 22, the center-to-center distance between adjacent windows 24 in adjacent horizontal rows is somewhat less than the center-to-center distance between adjacent windows in adjacent vertical rows. This represents a slight deviation from a true checkerboard arrangement of windows, but as aforesaid, it provides a window pattern wherein vertical alignment, horizontal alignment, and diagonal alignment of windows is still maintained without exerting appreciable visual effort.

With regard to the intermediate or guide sheet 20, such sheet is die-cut to provide a plurality of horizontally elongated rectangular guide slots 32, there being one slot for each window 24 and the various slots lying immediately behind their respective or associated windows when the game card assembly 10 is put together. The horizontal and vertical extent of each guide slot 32 is somewhat greater than the horizontal and vertical extent of its respective or associated window 24 and because each slot 32 directly underlies a respective window in centered relationship, the three cardboard sheets 18, 20, and 22 of the game board proper 12 establish a confining guideway immediately behind each window 24 within which one pair of the shutters 14 and 16 is slidably confined. The intermediate guide sheet therefor, in addition to its shutter-guiding function, also serves as a spacer sheet between the bottom backing sheet 18 and the top playing sheet 20.

Figure 3:
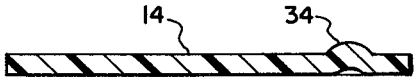
FIG. 3 is a slightly enlarged, sectional view taken on the vertical plane indicated by the line 3—3 of FIG. 2.
Figure 6:
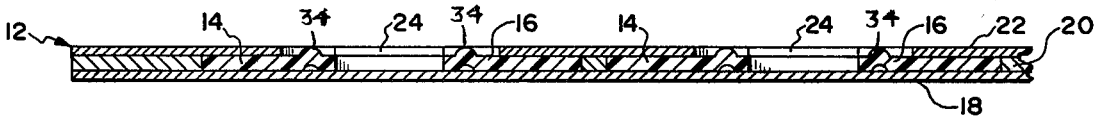
FIG. 6 is an enlarged, vertical, sectional view taken on the line 6—6 of FIG. 1.
Figure 7:
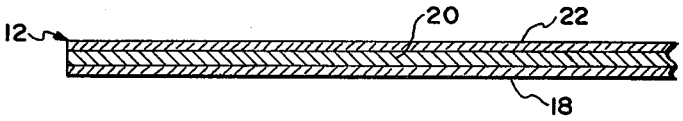
FIG. 7 is an enlarged, vertical, sectional view taken on the line 7—7 of FIG. 1.
Figure 8:
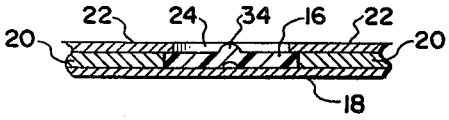
FIG. 8 is an enlarged, vertical, sectional view taken on the line 8—8 of FIG. 1.

The nature of the various slides or shutters 14 and 16 is best visualized in FIGS. 2 and 3. Each such shutter is in the form of an approximately square flat sheet of an opaque material, preferably of a suitable plastic such as polyethylene or the like, but which, if desired, may be in the form of cardboard stampings. Each shutter 14 and 16 is formed with an upwardly or outwardly facing offset protuberance 34 which constitutes a finger catch by means of which the shutter may be manipulated by use of the fingernail between open and closed positions across the face of its respective window 24 as will be described presently. As previously stated, each guide slot 32 contains a left-hand shutter 14 and a right-hand shutter 16 and the combined longitudinal extent of such pair of shutters is appreciably less than the longitudinal extent of the slot 32. As shown particularly in FIGS. 1 and 6 of the drawings, each pair of shutters normally assumes a retracted position wherein the two shutters 14 and 16 are spaced apart so that they bear against the opposite ends of their respective slot 32 with the upwardly extending protuberances 34 being nested well within the confines of the apices of the V-shaped recesses 30 at the opposite ends of the associated window 24. In playing the game, an operator may, by utilizing his or her fingernail, shift either a shutter 14 or a shutter 16 across the medial portion of the associated window 24 until it engages the other shutter in its retracted position, thereby effectively "closing" the window and concealing the blank or display space of the backing sheet 18 which normally is visible through the window.

According to the invention, means are provided for visually distinguishing the various left-hand shutters 14 from the right-hand shutters 16. This may be done in various ways, but preferably, it is accomplished by making the shutters of each pair from plastic material of different colors. For exemplary purposes, and as portrayed in FIGS. 4 and 5, each left-hand shutter is shaded to represent the color red, while each right-hand shutter is shaded to represent the color green. Obviously, other colors may be employed if desired, or alternatively, the shutters may be distinguished by printing or otherwise marking thereon suitable indicia such as a cipher on each shutter 14 and the letter "x" on each shutter 16.

Figure 4:
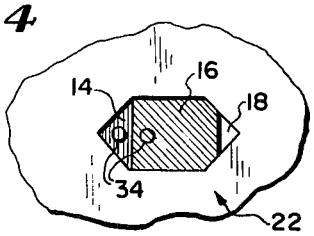
FIG. 4 is an enlarged, fragmentary, plan view of a portion of the game card assembly, the view being taken in the vicinity of one of the windows and showing the window closed by one of the two laterally slidable shutters which are associated therewith.
Figure 5:
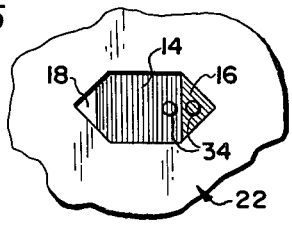
FIG. 5 is a fragmentary plan view similar to FIG. 4 but showing the illustrated window closed by the other shutter.

Still referring to FIGS. 4 and 5 of the drawings, it will be noted that when one of the shutters 16 is moved across its associated window opening 24 as shown in FIG. 4, the visible color offered by such window opening is largely green with the white background of the backing sheet 18 being totally obscured. Similarly, when one of the shutters 14 is moved across its associated window opening 24 and shown in FIG. 5, the visible color offered by the window is largely red. In either event, the exposed surface of the advanced shutter is of such predominance that there can be no uncertainty as to which move in the playing of the game has been made.

Briefly, and at the risk of repetition, it is stated that in playing the game which is offered by the present board-like game card assembly 10, each of the two players is assigned a shutter color, and shutter movements are made alternately by the players as in the game of tic-tac-toe. Each player attempts to block the other player from getting four similarly colored shutters in an uninterrupted horizontal, vertical, or diagonal row, and the first player to align his or her own shutters vertically, horizontally, or diagonally with a series of four shutters that are not interrupted by the other player's shutter wins the game. It is understood, of course, that at the commencement of any particular game, the shutters 14 and 16 of each pair are spread apart to their retracted positions wherein the white display area of the backing sheet 18 is plainly visible through all of the windows 24.

Referring again to FIG. 1, the various window openings 24 are collectively centered within the rectangular or square marginal confines of the front sheet 22 and the various windows may be connected together by vertical, horizontal, and diagonal lines 36 which may be printed on the upper or outer face of the front sheet in order that the players may more readily visualize or recognize the in-line arrangement of windows in four directions. If desired, various information such as the name of the game card assembly, suggested rules for game playing, decorative designs, promotional slogans or other descriptive literature may be printed on the upper face of the front sheet 22. For example, the dotted line rectangles labelled 40 at opposite corner regions of the sheet may contain duplicate rules for playing the game, the printing of such rules facing in opposite directions so that two players opposing each other on opposite sides of the game card assembly may readily refer to such rules. If desired, an irregular closed outline 42 may be printed on the front sheet 22 so as to encompass the window pattern.

The invention is not to be limited to the exact arrangement of parts shown in the accompanying drawings or described in this specification as various changes in the details of construction may be resorted to without departing from the spirit or scope of the invention. Therefore, only insofar as the invention is particularly pointed out in the accompanying claim is the same to be limited.

Having thus described the invention what I claim as new and desire to secure by Letters Patent is:

1. A game card assembly for use in connection with a game such as tic-tac-toe, said assembly comprising a laminated game board including a bottom backing sheet, a top sheet, and an intermediate guide sheet, adjacent sheets being adhesively secured together in face-to-face relationship in order to provide a three-ply laminated game board, said top sheet being formed with a plurality of elongated window openings which are quadrilaterally arranged substantially in checkerboard fashion so as to provide windows which are disposed in vertical, horizontal and diagonal rows, each window opening being in the form of a horizontally elongated hexagonal opening having parallel horizontally extending edges, together with V-shaped notch-like recesses at the opposite ends of the opening, each window opening, exclusive of said recesses, defining a square medial display area, said intermediate guide sheet being formed with a plurality of elongated guide slots, there being one slot in register with each window opening, the longitudinal and transverse extent of each slot being greater than the longitudinal and transverse extent of its respective window opening so that the peripheral regions of the slot are overlapped by the edge regions of the window opening, and a pair of substantially flat differently colored rectangular shutters slidably disposed in each slot and normally assuming spaced apart retracted positions wherein the major end portions thereof project beneath the top sheet and so that the medial display area of the backing sheet is visually exposed through the window opening between the spaced apart shutters, each shutter being individually movable to an advanced position wherein an opposed edge of such shutter meets the adjacent opposed edge of the other retracted shutter with a major portion of the moved shutter extending across and covering and thus concealing the display area of the associated window opening and rendering a visible color indication of its presence in such advanced position, and a finger catch in the form of a small protuberance projecting upwardly from the top surface of each shutter in the vicinity of its meeting edge, the ends of said guide slots in the intermediate guide sheet constituting limit stops for the adjacent ends of the shutters so that when the shutters are in their retracted positions the finger catches thereon are maintained free from the edges of the notch-like recesses at the ends of the window openings, thus inhibiting wear between the protuberances and such recesses and affording fingernail access to the protuberances during continued use of the game card assembly, said quadrilaterally arranged window openings being thirty-four in number and the checkerboard arrangement thereof involving seven vertical rows of window openings embodying containments of two, five, six, eight, six, five and two in the various vertical rows reading horizontally in either direction, and eight horizontal rows of window openings embodying containments of one, four, five, seven, four, five and one in the various horizontal rows, reading vertically in either direction.

* * * * *